US007789261B2

(12) United States Patent
Kubo et al.

(10) Patent No.: US 7,789,261 B2
(45) Date of Patent: Sep. 7, 2010

(54) EASY OPEN CAN END WITH SCORE

(75) Inventors: Hiroshi Kubo, Tokyo (JP); Katsumi Kojima, Tokyo (JP); Hiroki Iwasa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 1566 days.

(21) Appl. No.: 10/996,444

(22) Filed: Nov. 26, 2004

(65) Prior Publication Data

US 2005/0067418 A1 Mar. 31, 2005

(30) Foreign Application Priority Data

Mar. 28, 2003 (JP) ..... 2003-092116

(51) Int. Cl.
*B65D 17/34* (2006.01)

(52) U.S. Cl. ..... 220/269; 220/619

(58) Field of Classification Search ..... 220/269, 220/271–273, 619, 906
See application file for complete search history.

(56) References Cited

U.S. PATENT DOCUMENTS

| | | | | |
|---|---|---|---|---|
| 3,359,773 | A * | 12/1967 | Stuchbery | 72/325 |
| 4,503,989 | A * | 3/1985 | Brown et al. | 220/269 |
| 5,671,860 | A * | 9/1997 | Louwerse et al. | 220/276 |
| 5,738,237 | A * | 4/1998 | McEldowney | 220/269 |
| 6,435,368 | B1 * | 8/2002 | Yamanaka et al. | 220/268 |

* cited by examiner

*Primary Examiner*—Robin Hylton
(74) *Attorney, Agent, or Firm*—Young & Thompson

(57) ABSTRACT

A open can end of laminated steel sheet has a score formed thereon by a scoring die. The scoring die has a scoring edge having a sectional shape of an inverted triangle. The scoring edge includes a tip formed of a curve having a radius of curvature of 0.2 mm or more and 0.4 mm or less. Two sides sandwiching the tip are tangent to the curve. A function tan θ of an angle of elevation θ of each of the sides with respect to a surface of the can end is 0.3 or more and 1.0 or less. The resultant a can end being an easy open can end.

3 Claims, 2 Drawing Sheets

EASY OPEN CAN END WITH SCORE

BACKGROUND OF THE INVENTION

1. Field of the Invention

The present invention relates to a metallic container cover and, more particularly, to a scoring die to be used for manufacturing an easy open can end which can be manually opened with ease partially or wholly of a can cover using a laminated steel sheet, a method for manufacturing the easy open can end, and the easy open can end.

2. Description of the Related Art

The easy open can end uses aluminum mainly for its material. A lacquered steel sheet is inexpensive as the material but needs a repair-coating step after worked, so that it has less economical merits. For these situations, it is under the situation that the steel sheet is not positively utilized.

Under this background, various trials have been made by devising the cover working method and by using the laminated steel sheet according to the working method for, omitting the step of repair-coating the easy open end made of the steel sheet.

Patent Publication 1: JP-A-06-115546 has tried a non-repair by devising the method for working a V-shaped score of the prior art, in which a flat portion is formed on the score bottom by using a polyester resin. Patent Publication 2: JP-A-09-234534 has devised the scoring method while regulating the thickness and the breaking elongating of the resin layer. Patent Publication 3: JP-A-11-01775 has tried the non-repair by using a curved die in the scoring work.

Here will be described information on the technical publications of the prior art.

Irrespective of these inventions, however, the cover made of aluminum has a monopoly position in the market. In not only the beverage can market but also the food can market, along with the easy opening trend, it is under the situation that the easy open end of aluminum is rather increasing. This situation verifies that the merit to make a change from the cover of aluminum to the cover of a laminated steel sheet is not accepted by the market.

The reason why the laminated steel sheet covers are hard accepted in the market is thought to come from the fact that some of them can be applied but most of them cannot in dependence upon the requirement levels such as the contents to be charged into the can, the design of the can, the cover manufacturing method or the manufacturing method. This insufficient application is thought for the following reason. If the scored remaining portion is thinned, the openability is improved, but a strict working is required for the film. This makes the non-repair difficult so that the openability and the non-repair are not compatible.

By solving the problems thus far described, the laminated steel sheet is really enabled to participate into the market. This real participation of the inexpensive laminated steel sheet into the market is not limited to a reduction in the can cost. It is needless to say that the whole steel can is excellent in the viewpoint of recycling, but the steel itself has a lower load on the environment than aluminum. Therefore, this transfer of the material has a high industrial meaning.

SUMMARY OF THE INVENTION

It is an object of the present invention to provide a scoring die suited for scoring an easy open can end, in which the openability and the non-repair are compatible even with a thin scored remaining thickness, a method for manufacturing the easy open can end, and the easy open can end.

The means of the present invention for solving the above-specified problems are as follows.

(1) A scoring die to be employed for scoring a easy open can end made of a laminated steel sheet, comprising a scoring edge having a sectional shape of an inverted triangle, wherein the scoring edge includes a tip formed of a curve having a radius of curvature of 0.2 mm or more and 0.4 mm or less, wherein two sides sandwiching the tip are tangent to the curve, and wherein the function tan θ of the angle of elevation θ of each of the sides with respect to the cover face is 0.3 or more and 1.0 or less.

It is preferable that the radius of curvature is 0.25 mm or more and 0.35 mm or less.

It is preferable that the function tan θ of the angle of elevation θ is 0.5 or more and 0.9 or less.

(2) A method for manufacturing a easy open can end to score the outer face side of a laminated steel sheet having resin films on its two faces, with a scoring die, wherein the scoring die according to Item (1) is used as an upper die whereas a die having a flat upper face is used as a lower die, and wherein the laminated steel sheet is pushed with the upper die to score the laminated steel sheet.

It is preferable that the laminated steel sheet comprises a steel sheet having a thickness of 0.15-0.25 mm and the resin film having a thickness of 10-100 μm.

(3) A easy open can end using a laminated steel sheet, wherein a score is formed into a recess having a sectional shape of an inverted triangle, wherein the recess has its leading end portion formed of a curve having a radius of curvature of 0.2 mm or more and 0.4 mm or less, wherein two sides sandwiching the leading end portion are tangent to the curve, and wherein the function tan θ of the angle of elevation θ of each of the sides with respect to the cover face is 0.3 or more and 1.0 or less.

It is preferable that the radius of curvature is 0.25 mm or more and 0.35 mm or less.

It is preferable that the function tan θ of the angle of elevation θ is 0.5 or more and 0.9 or less.

It is preferable that the leading end portion has a thickness of 50-70 μm.

DESCRIPTION OF THE EMBODIMENT

Figure 1:
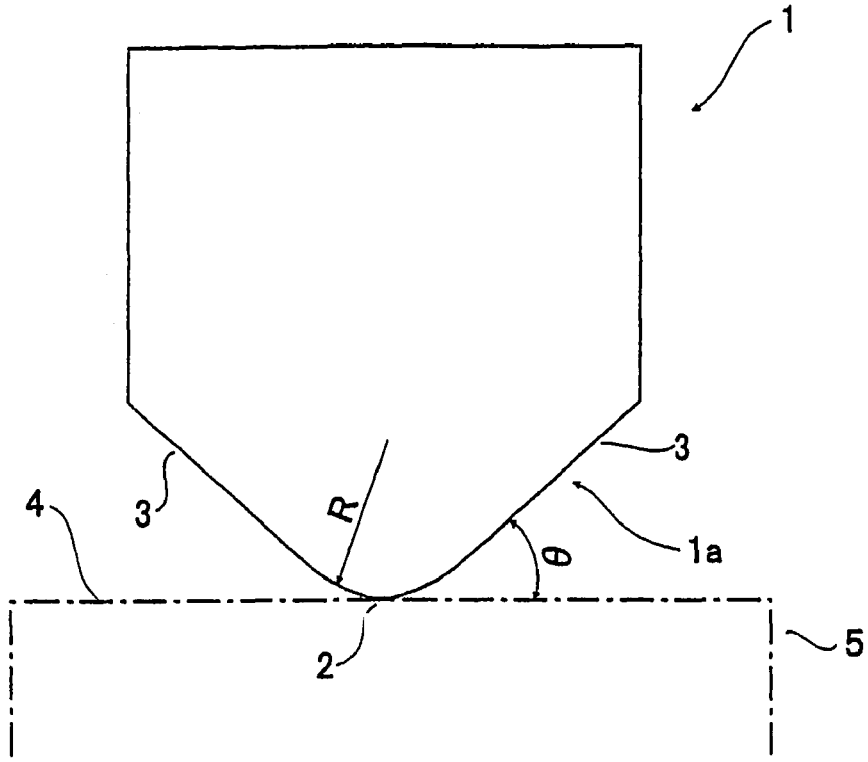
FIG. 1 is a sectional view of a scoring die according to an embodiment of the present invention.

According to our investigations, it has been found that the openability of the easy-open end was dominated not by the shape of the score but by the scored remaining thickness. Specifically, the influence of the score shape is low, and when the scored remaining thickness becomes small, then, the force for opening the can becomes low in proportion to the thickness. On the other hand, the reduction in the scored remaining thickness means that the scoring degree becomes severe for any of the working methods. As the working degree becomes severe, the film becomes liable to be broken so that the corrosion resistance is hard to keep thereby to need the repair-painting. For the compatibility between the non-repair and the openability, therefore, the film should not be broken even if the scored remaining portion is thinned. The present invention provides a scoring method, by which the film is harder to break in case the cover is scored to the same remaining thickness, and a cover manufactured by the scoring method.

It has been touched under Description of the Related Art that the various trials were made on the scoring method and that the film was proposed according to the scoring method. Especially, the curved die used in Patent Publication 3 or the like is excellent in that it has a simple structure and hardly damages the resin layer. However, in the scoring case of reducing the remaining thickness or in the case of the thick sheet, the scoring treatment becomes more severe so that the effect to prevent the breakage of the film becomes insufficient.

In the scoring case with the curved die, the film is not only elongated by the press but also subjected to a shearing stress on the side to contact with the die. If it is assumed that the die has a V-type sharp tip, it is easily imagined that the shearing force becomes dominant in scoring. In this respect, the curved die has a tendency to have a lower shearing stress than that of the V-type one and is more advantageous. In the strict working case, however, the film breakage still occurs. We have investigated the broken state of the film and have found that the breakage occurred not at the portion of the thinnest film but at the portion near the edge of the score.

This reason is examined in the following. It is thought that the boundary between the portions where the scoring die does and does not contact with the steel sheet in the scoring work of the curved shape has the more shear as a tangent at the boundary is the more inclined. If the inclination is vertical (in the scoring case with a scoring die with a scoring edge having a sectional shape of a rectangle), the boundary point is subjected to the shearing treatment. If the inclination is approximate 0 (at the lowermost point of the curved die), on the contrary, the shearing component is extremely reduced. From this fact, it is considered that the shearing component becomes the higher for the larger inclination of the tangent. Therefore, it can be said that the shearing component is low at the bottom of the curve but high at the end portions. Moreover, the inclination at each point on the curve is expressed by tan θ (where letter θ indicates the angle made between the lines joining the individual points and the center point of the curve, i.e., the lowermost point of the curve), so that the inclination has a tendency to become abruptly large as the angle θ becomes large. In the scoring procedure, on the other hand, the curve is pressed only near its lowermost portion at an extremely initial time but worked up to its end as the operation proceeds. It has been observed from the severe working result that the film was broken not at its thinnest portion but at its portion near the score ends. This is thought to come from the fact that the shearing component is high at that portion.

On the basis of this consideration result, we have tried various tests by making such a device on the die as not to make the inclination excessively large (i.e., as to prevent the inclination from exceeding a predetermined value). These test results have led to the invention.

The present invention will be described in more detail in the following. FIG. 1 is a sectional view of a scoring die according to the embodiment of the present invention.

In FIG. 1, a scoring die 1 has an edge 1*a* formed into a sectional shape of an inverted triangle. The scoring edge 1*a* of the die has a tip 2 formed of a curve of a radius of curvature R. Two sides 3 and 3 sandwiching the tip 2 are made tangent to the tip 2. Here, the scoring edge 1*a* is such a ridge of the scoring die as to score an end body (of laminated steel sheet) 5 by pressing it. In FIG. 1, letter θ designates the angle of elevation of the sides 3 with respect to a cover face 4. In the present invention, the radius of curvature R is set from 0.2 mm or more to 0.4 mm or less, and the function tan θ of the angle of elevation θ is set from 0.3 or more to 1.0 or less.

Here will be described the reasons why the sectional shape of the scoring edge 1*a* of the die 1 is so set as has been described hereinbefore.

If the two sides 3 and 3 sandwiching the tip 2 of the scoring die 1 are not tangent to the curve of the tip 2, the angle of elevation to the steel sheet face so abruptly changes at the point of intersection between the sides 3 and the curve of the tip 2 that the portions become hard to work thereby to make the film easily breakable. If the sides 3 are made tangent to the curve of the tip 2, on the contrary, the angle of elevation of the portions (or contact points) with respect to the steel sheet face smoothly changes to make the film hard to break.

In case the radius of curvature R is 0.2 mm or more and the sides 3 have an inclination (or the angle of elevation with respect to the end face) of tan θ less than 1.0, the film becomes less breakable than when it is simply worked with the curve having the radius of curvature R. In case the radius of curvature R exceeds 0.4 mm, the score width becomes excessively large, and the working degree has an undesirable tendency to rises thereby to make the film work severe. If the radius of curvature R is less than 0.2 mm, the ratio of occupation of the sides rises to increase the portions having shearing components thereby to make the film breakable. In case the angle of elevation θ is less than 0.3 in terms of tan θ, on the contrary, the score width becomes excessive, and the working degree has undesired tendency to rise thereby to make the film work severe.

Here will be described the concepts and actions of the present invention, in which the two sides sandwiching the tip 2 of the scoring edge 1*a* of the scoring die 1 are tangent to the curve of the tip 2, and in which the radius of curvature of the tip 2 is set within the range of 0.2 to 0.4 mm. In the present invention, it is significant that the sides 3 are tangent to the curve of the tip 2 of the scoring edge 1*a* in order to reduce the shearing component of the stress to act at the scoring time. In the scoring work of a sectional shape of a regular circle, the sharing component becomes high at the portions apart from the center (or the bottom portion of the score). It is the concept of the tangent that consideration is taken not to make the shearing component ratio larger than a constant value. So long as the tangent is of the regular circle, however, the shearing component takes the maximum at the tangent portion in the die of the present invention (although not in excess of the value of the case of the regular circle). Considering only this point, the shorter tangential portion is the more desirable. In order to reduce the length of the tangential portion, it is conceivable to enlarge the radius of curvature of the regular circle. In this case, however, the working degree grows the more, and the working extent becomes the stricter as a whole, so that the film becomes the more breakable to the contrary. If the radius of curvature of the regular circle is reduced, the ratio of the tangential portion becomes high to increase the portion having the larger shearing component thereby to make the film breakable. From the points thus far explained, it is specified in the present invention that the radius of curvature is set from 0.2 mm or more to 0.4 mm or less.

If the two sides 3 and 3 sandwiching the tip 2 of the scoring edge 1*a* are made tangent to the curve of the tip 2, the effect to prevent the breakage of film is revealed to the maximum. However, this effect to prevent the film breakage is also revealed, so long as the angle of elevation to the steel sheet face is not abruptly changed at the points where the sides 3 and the curve of the tip 2 intersect, as described herein before. Considering this point, according to the invention, the two sides sandwiching the tip 2 of the scoring edge 1*a* need not be strictly the tangent of the curve of the tip 2 but may also be substantially tangent ones. Here, the substantially tangent sides imply the sides which are inclined within a range of about ±3 degrees from the strict tangents.

Figure 2:
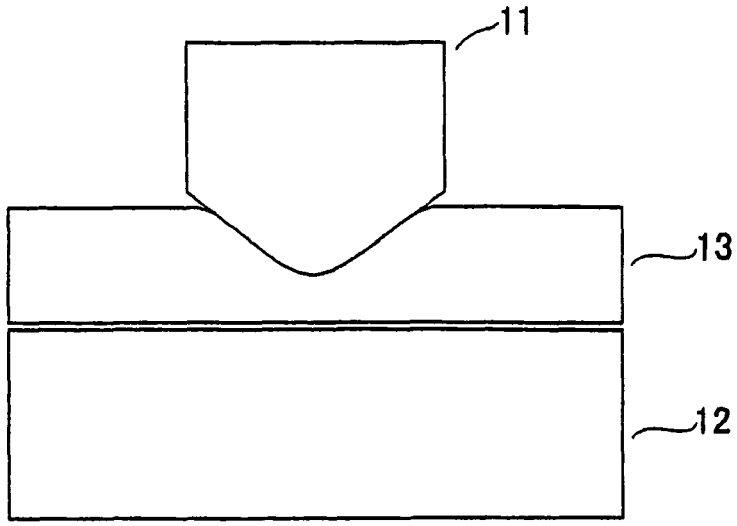
FIG. 2 is a schematic section for explaining a die-pressing procedure of a cover.

With reference to FIG. 2, here will be described a method for manufacturing an easy open can end with the scoring die. An upper die 11 is exemplified by the scoring die 1 according to the embodiment of the present invention, as has been described in FIG. 1 hereinbefore, and a lower die 12 is exemplified by one having a flat upper face. With the upper die 11, an essential portion corresponding to the score shape size of an end body 13 (of a laminated steel sheet) 13 is pressed to form the desired score in the end body 13. The end body thus manufactured has a scored section substantially identical to that of the scoring die excepting the score edge.

By using the scoring die specified in the invention for the upper die 11, the end body 13 manufactured is hard to break at its film even if the scored remaining portion is thinned, so that the openability and the non-repair are compatible.

Figure 3:
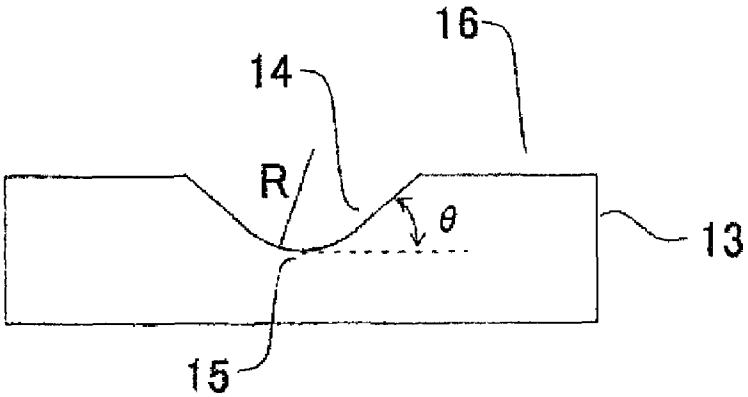
FIG. 3 is a schematic section showing a score formed on the laminated steel sheet of a can end.
Figure 4:
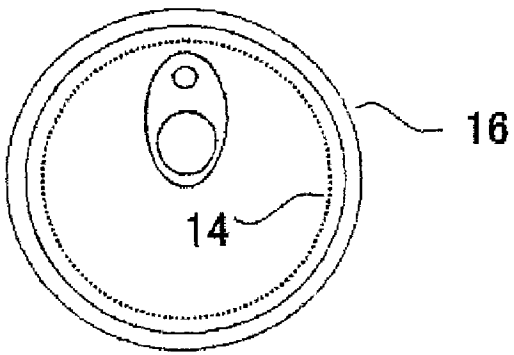
FIG. 4 shows a top view of the can end.

FIGS. 3 and 4 schematically show the score 14 formed on the laminated steel sheet 13 of a can end 16. FIG. 4 shows the score 14 on the can end 16 as viewed from above. In FIG. 3, the leading end portion 15 is shown formed as a curve having a radius of curvature R. One side sandwiching the leading end portion is shown with an angle of elevation θ.

The laminated steel sheet of the present invention can be prepared by forming a resin film on variously surface-treated steel sheets of a material by adhesion, lamination or the like. This surface-treated steel sheet is suitably prepared by plating a steel sheet surface with one kind, two kinds or more of tin, zinc, nickel or chromium or their alloys, and by further subjecting the plated steel sheet to a chemical conversion treatment such as a chromate treatment or a phosphate treatment. Of those surface-treatment steel sheets, the especially preferred one is the so-called "tin-free steel", on which a chromate film of the metallic chromium layer and the overlying chromium hydrate layer are formed.

As the resin film to be applied, a resin film composed of one kind, two kinds or more of thermoplastic resins such as polyester or polyamide is used from the performances of a food sanitization, a corrosion resistance, a workability and so on. It is more desired for balancing the film properties of a film breaking extension, a tensile strength, a tensile elasticity and so on at a high level to use the film made of one layer, two layer or more of thermoplastic resins such as polyester resins.

The specific polyester resin film to be used is a linear thermoplastic polyester film produced by the condensation polymerization of dicarboxylic acid and diol, and is represented by polyethylene terephthalate. The dicarboxylic component is a single substance or mixture of terephthalic acid, isophthalic acid, phthalic acid or the like, and the diol component is a single substance or mixture of ethylene glycol, butadiene glycol, decanediol or the like. The diol component may also be a copolymer of two kinds or more of dicarboxylic component and diol component, or a copolymer of other monomers or polymers such as diethylene glycol. In the laminating method, the film itself is heat-bonded, or a thermoset adhesive is applied and adhered to the steel sheet face.

The resin film is easily broken, if excessively thin, by the treatment. In the case of a thickness of 100 microns or more, the phasing properties are easily deteriorated after the can was opened, and the cost is raised undesirably from the economic aspect. Therefore, it is desired that the resin film has a thickness within a range of 10 to 100 microns.

It is preferred for the effects of the present invention that the steel sheet has a thickness of 0.15 mm to 0.25 mm, and that the scored remaining thickness is 50 to 70 microns for the satisfactory operability.

The present invention can be applied to any of the pull-top tab type can cover, the stay-on tab type can cover and the full-open type can cover.

EXAMPLES

"Preparation of Samples"

The tin-free steel, which had been prepared by forming the two faces of a steel sheet having a thickness of 0.200 mm with chromate layer composed of a metallic chromium layer in quantity of 100 to 120 mg/m$^2$ and an overlying a hydrated chromium oxide layer in quantity of 14 to 18 mg/m$^2$, as converted in metallic chromium, was laminated with a PET (Poly-Ethylene Terephthalate) film having a thickness of 20 microns.

The laminated steel sheets thus prepared were pressed either by the die, as shown in FIG. 1, which had been constructed such that the scoring edge 1*a* had the sectional shape of the inverted triangle, such that the tip 2 was formed of the curve having the radius of curvature R and such that the two sides 3 and 3 sandwiching the tip 2 were tangent to the curve of the tip 2, for the various radii of curvature of the tip 2 and for the various angles of elevation θ to the cover face, or by the curved die, which had a sectional shape of a curve having the radius of curvature R. The steel sheets thus pressed were scored to have the minimum thickness (i.e., the thickness of only the steel sheets) of 70 microns. The corrosion resistances of the scored portions were-investigated in the following manners.

"Corrosion Resistance Tests"

The worked portions were dipped in an electrolyte (i.e., a 5% solution of KCl at the ordinary temperature). When a voltage of 6.2 V was applied between the steel sheets and the electrolyte, the judgment was made to good, in case the current value measured was 1 mA or less, and to bad in case the current value was more than 1 mA.

The evaluation results of the scoring conditions and the corrosion resistances are enumerated in Table 1.

TABLE 1

| | Radius of curvature R (mm) | Angle of elevation tan θ | Corrosion Resistance | Remarks |
|---|---|---|---|---|
| Example 1 | 0.3 | 0.7 | Good | |
| Example 2 | 0.2 | 0.7 | Good | |
| Example 3 | 0.4 | 0.7 | Good | |
| Example 4 | 0.3 | 1.0 | Good | |
| Example 5 | 0.3 | 0.3 | Good | |
| Comparative Example 1 | 0.1 | 0.7 | Bad | |
| Comparative Example 2 | 0.5 | 0.7 | Bad | |
| Comparative Example 3 | 0.3 | 1.1 | Bad | |
| Comparative Example 4 | 0.3 | 0.2 | Bad | |
| Comparative Example 5 | 0.3 | No Tangent | Bad | Curved Die |

Examples 1 to 5 were within the specified range of the present invention and exhibited satisfactory corrosion resistance.

Comparative Example 1 was inferior in the corrosion resistance, because the radius of curvature had been so small that the shearing force strongly acted. Comparative Example 2 was also inferior, because the radius of curvature had been so large that the scoring degree was high. Comparative Example 3 was also inferior in the corrosion resistance, because the inclination of the tangent had been so large that the score end portions cracked. Comparative Example 4 was also inferior in the corrosion resistance, because the inclination of the tangent had been so small that the working degree increased. Comparative Example 5 presents the curved die and was also inferior in the corrosion resistance, because the film had been broken near the score end portions.

According to the present invention, the damage of the films can be prevented even by reducing the scored remaining thickness, so that the openability and the non-repair are compatible. The present invention can be applied to any of the pull-top tab type can cover, the stay-on tab type can cover and the full-open type can cover.

What is claimed is:

1. An easy open can-end, comprising:

a resin-laminated steel sheet;

a score formed on the laminated steel sheet, the score having a sectional shape of an inverted triangle;

the score having a leading end portion formed of a curve having a radius of curvature of 0.2 mm or more and 0.4 mm or less and the leading end portion having a thickness of 50-70 μm;

two sides for sandwiching the leading end portion being tangent to the curve; and each of the sides having an angle of elevation with respect to a surface of the can-end, a tangent of the angle of elevation being at least 0.3 and no more than 1.0.

2. The easy open can-end according to claim 1, wherein the radius of curvature is at least 0.25 mm and no more than 0.35 mm.

3. The easy open can-end according to claim 1, wherein the tangent of the angle of elevation is at least 0.5 and no more than 0.9.

* * * * *